US005936460A

United States Patent [19]

Iravani

[11] Patent Number: 5,936,460

[45] Date of Patent: Aug. 10, 1999

[54] CURRENT SOURCE HAVING A HIGH POWER SUPPLY REJECTION RATIO

[75] Inventor: Kamran Iravani, San Jose, Calif.

[73] Assignee: VLSI Technology, Inc., San Jose, Calif.

[21] Appl. No.: 08/972,790

[22] Filed: Nov. 18, 1997

[51] Int. Cl.[6] ..... G05F 1/10

[52] U.S. Cl. ..... 327/543; 327/509; 327/530; 327/538; 323/312; 323/315

[58] Field of Search ..... 323/312, 315; 327/509, 530, 538, 543, 545, 546

[56] References Cited

U.S. PATENT DOCUMENTS

| | | | |
|---|---|---|---|
| 4,461,991 | 7/1984 | Smith | 323/315 |
| 4,567,426 | 1/1986 | Van De Plassche et al. | 323/315 |
| 5,059,890 | 10/1991 | Yoshikawa et al. | 323/315 |
| 5,512,816 | 4/1996 | Lambert | 323/315 |
| 5,594,382 | 1/1997 | Kato et al. | 327/543 |
| 5,777,509 | 7/1998 | Gasparik | 323/315 |

*Primary Examiner*—Timothy P. Callahan
*Assistant Examiner*—Jung Ho Kim
*Attorney, Agent, or Firm*—Wagner Murabito & Hao

[57] ABSTRACT

The present invention comprises a noise insensitive current source circuit having a high power supply rejection ratio. The circuit of the present invention is for use with noise sensitive circuits. The circuit of the present invention includes a first reference current source, a second reference current source, and a first, second, third, and fourth transistor. The first transistor has a drain coupled to a power supply and a source coupled to a ground via the first reference current. The second transistor has a drain coupled to the power supply and a source coupled to ground via the second reference current source. The gate of the second transistor is coupled to the gate of the first transistor and to the source of the first transistor. A third transistor has a drain coupled to the power supply and a source coupled to ground via the second reference current source. The gate of the third transistor is coupled to the source of the second transistor. The fourth transistor has a drain coupled to the power supply and a source adapted to coupled to a noise sensitive circuit. The gate of the fourth transistor is coupled to the gate of the third transistor such that the noise sensitive circuit receives a current from the power supply via the fourth transistor and the noise insensitive current source effects a high power supply rejection ratio.

10 Claims, 3 Drawing Sheets

CURRENT SOURCE HAVING A HIGH POWER SUPPLY REJECTION RATIO

TECHNICAL FIELD

The present invention relates to the field current sources for circuits having a relatively high sensitivity to noise. More particularly, the present invention relates to a current source circuit having an improved power supply rejection ratio for use with noise sensitive circuits.

BACKGROUND ART

Many electronic devices commonly used in the electronics industry are sensitive to noise on their power supplies. The degree of this sensitivity often depends upon the particular application the device is designed to implement. Some applications require implementing circuits which are so precise in nature, the circuits cannot function properly in the presence of even small amounts of power supply noise. Such applications include, for example, frequency synthesizers, signal generation (e.g., serial clock recovery), most circuits incorporating voltage controlled oscillators (VCO), and the like. The circuits which implement the above types of applications are particularly sensitive to electronic noise, especially on their power supplies.

For example, in the case of VCOs, typical prior art VCOs generate an oscillating output signal having a specified frequency. In most VCO applications, it is important that the output frequency of the VCO is stable and is a consistent function of the control inputs (e.g., voltage, capacitance, and the like). Where the VCO is used in an application for clock recovery in a serial transmission system, it is important that the output frequency remain stable and constant. Distortion or variation in the VCO output frequency, and hence, the reconstructed clock signal, could lead to sampling errors, lost data, decreased throughput, or other such problems. However, power supply noise can have a very detrimental effect on the VCO's output stability. As a typical VCO draws current from a power supply, the noise with this current (or voltage), or noise from other external devices (e.g., electromagnetic interference), can affect the output frequency. Such noise typically manifests itself as jitter on the rising and falling edges of the output signal, frequency skew in the output signal, or other distortions in the fidelity of the output. Hence, VCOs and other such circuits are considered very noise sensitive devices.

Power supplies for noise sensitive devices are carefully filtered to remove this problematic noise. While higher frequencies are somewhat easier to remove, low frequency noise has proven more difficult and more expensive (e.g., with respect to silicon area or circuit board space) to remove. While this solution is partially effective, as applications have become more complex and as noise sensitivity has increased with increasing levels of integration, power supply noise, particularly low frequency power supply noise, remains problematic. Typical prior art solutions have not proven completely effective.

Prior Art FIG. 1 shows a typical prior art system 100 including a current source for a noise sensitive device. System 100 includes a transistor m1 and a transistor m2. The sources of transistors m1 and m2 are coupled to Vdd (e.g., 3.3v). The drain of transistor m1 is coupled to a current source Iref, which is in turn, coupled to ground. The node between the current source Iref and transistor m1 is coupled to the gates of transistors m1 and m2. A noise sensitive circuit 10 is coupled to receive current from Vdd via transistor m2.

System 100 functions by maintaining a constant current from Vdd to the noise sensitive circuit. The current source Iref is a reference current source having a constant amplitude. Since the node above current source Iref is coupled to the gates of transistors m1 and m2, changes in Vdd should cause corresponding correcting changes in Vgs (e.g., voltage between the gate and the source) for transistors m1 and m2, causing the current flowing through transistor m1 to "mirror" the current flowing through m2. As the voltage level of Vdd changes (e.g., due to noise), the current transmitted to the noise sensitive-circuit via transistor m2 should remain constant. In so doing, noise on Vdd should be isolated from the noise sensitive circuit, allowing the noise sensitive circuit (e.g., a VCO cell of a VCO) to properly function.

The problem with prior art system 100, however, is that the voltage at the drain of transistor m1 does not increase as much as the voltage at the drain of transistor m2. Hence, the current flowing to the noise sensitive circuit cannot precisely mirror the current flowing through transistor m1. This allows noise from Vdd to "leak" through to the noise sensitive circuit and affect its operation.

Thus, what is required is a circuit which solves the power supply noise problems associated with the prior art. What is required is a system capable of provide a noise free current to coupled noise sensitive circuits. What is required is a circuit that prevents noise sensitive devices from being adversely affected by noise in their power supply and exhibits higher power supply noise rejection. Accordingly, the present invention provides a novel solution to the above requirements.

DISCLOSURE OF THE INVENTION

The present invention provides a VCO circuit which solves the power supply noise problems associated with the prior art. The circuit of the present invention provides a noise free current to noise sensitive circuits that are coupled thereto. The circuit of the present invention prevents noise sensitive devices from being adversely affected by noise on their power supply and exhibits higher power supply noise rejection than the prior art.

In one embodiment, the present invention comprises a noise insensitive current source circuit having a high power supply rejection ratio. The circuit of the present invention is for use with noise sensitive circuits. The circuit of the present invention includes a first reference current source, a second reference current source, and a first, second, third, and fourth transistor. The first transistor has a source coupled to a power supply and a drain coupled to a ground via the first reference current. The second transistor has a source coupled to the power supply and a drain coupled to ground via the second reference current source. The gate of the second transistor is coupled to the gate of the first transistor and to the drain of the first transistor. A third transistor has a source coupled to the power supply and a drain coupled to ground via the second reference current source. The gate of the third transistor is coupled to the drain of the second transistor. The fourth transistor has a source coupled to the power supply and a drain for coupling to a noise sensitive circuit. The gate of the fourth transistor is coupled to the gate of the third transistor such that the noise sensitive circuit receives a current from the power supply via the fourth transistor and the noise insensitive current source circuit effects a high power supply rejection ratio. In so doing, the circuit of the present invention prevents noise sensitive devices from being adversely affected by noise on their power supply and exhibits higher power supply noise rejection than the prior art.

BRIEF DESCRIPTION OF THE DRAWINGS

The accompanying drawings, which are incorporated in and form a part of this specification, illustrate embodiments of the invention and, together with the description, serve to explain the principles of the invention.

Prior Art

BEST MODE FOR CARRYING OUT THE INVENTION

Reference will now be made in detail to the preferred embodiments of the invention, a current source having a high power supply rejection ratio, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

The present invention provides a current source circuit which solves the power supply noise problems associated with the prior art. The circuit of the present invention provides a noise free current for coupled noise sensitive circuits. The circuit of the present invention prevents noise sensitive devices from being adversely affected by noise on their power supply and exhibits higher power supply noise rejection than the prior art. The present invention and its benefits are further described below.

Figure 1:
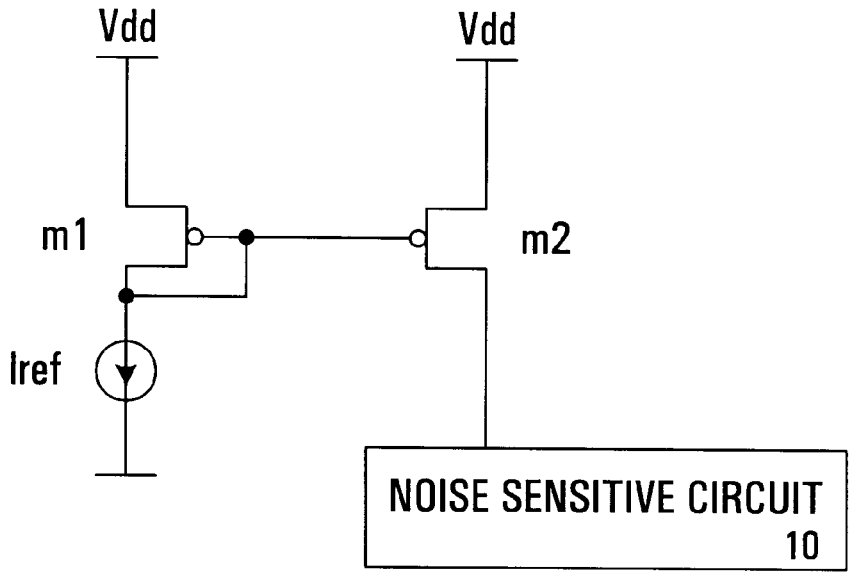
FIGURE 1 (PRIOR ART)
FIG. 1 shows a prior art current source circuit.
Figure 2:
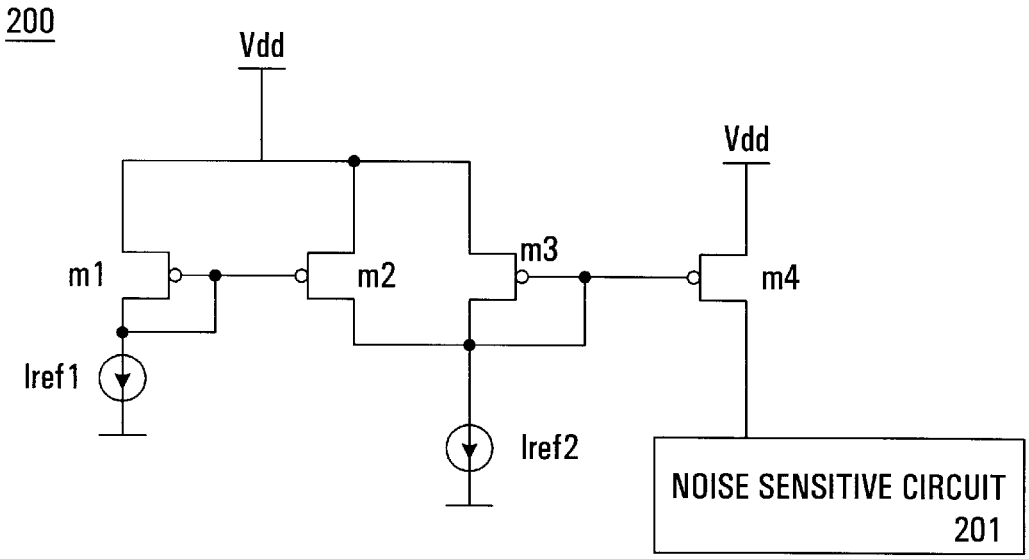
FIG. 2 shows a current source circuit in accordance with one embodiment of the present invention.

FIG. 2 shows a schematic diagram of a current source circuit 200 in accordance with one embodiment of the present invention. Circuit 200 of the present invention includes a first current source Iref1, a second current source Iref2, and four transistors m1 through m4. A power supply Vdd (e.g., 3.3v) is coupled to the sources of transistors m1–m4. The drain of transistor m1 and the gates of transistors m1 and m2 are coupled to ground via current source Iref1. The drains of transistors m2 and m3 and the gates of transistors m3 and m4 are coupled to ground via current source Iref2. Transistor m4 is coupled to transmit the output current Iout to the noise sensitive circuit 201.

Circuit 200 functions by providing a stable, noise free output current Iout to the coupled noise sensitive circuit 201. Circuit 200 accomplishes this by controlling the voltage at the gate of transistor m4, and hence Vgs of transistor m4. The voltage at the gate of transistor m4 is controlled such that Iout remains constant and unaffected by changes in the voltage level of Vdd (e.g., noise). Current sources Iref1 and Iref2 flow a constant amount of current to ground. Hence, changes in Vdd cause corresponding changes at the gates of transistors m1–m4.

Since the current source Iref1 flows a constant current to ground, an increase in the voltage of Vdd causes a corresponding increase in the voltage at the drain of transistor m1. However, the voltage at the drain of m2 will not exactly follow the changes at Vdd. This is because m2 is not a diode connected transistor. Therefore, the current flowing through m2 will increase by some ΔI. Since Iref2 is a constant current, the current flowing through transistor m3 will decrease by ΔI. This causes the voltage at the gate of transistor m3 to be adjusted in such that the current flowing through transistor m4 remains constant.

Consequently, circuit 200 of the present invention controls the output current Iout flowing to the noise sensitive circuit 201 much more accurately than the prior art. Circuit 200 of the present invention controls the voltage at the gate of transistor m4 such that the output current Iout mirrors the current source Iref. In so doing, the output current Iout remains constant regardless of noise in Vdd. The output current Iout remains much more constant in comparison the prior art. This allows circuit 200 of the present invention to maintain a high power supply rejection ratio. In the present embodiment, each of transistors m1–m4 of circuit 200 are p-channel transistors.

Figure 3:
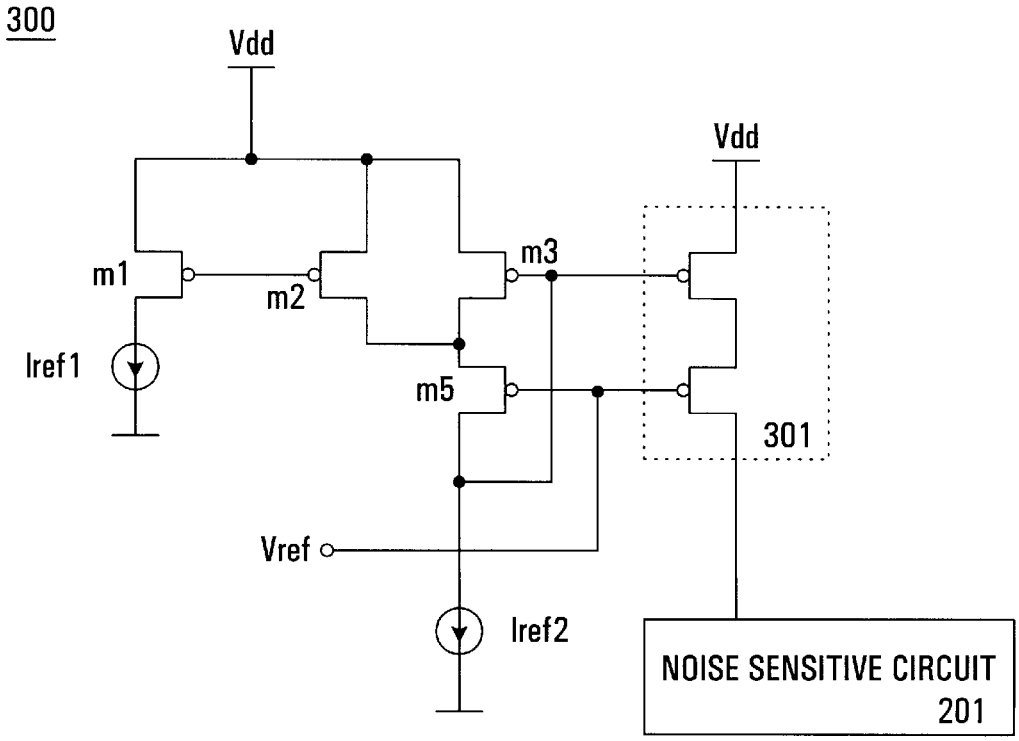
FIG. 3 shows a current source circuit in accordance with an alternate embodiment of the present invention.

Referring now to FIG. 3, a current source circuit 300 in accordance with an alternate embodiment of the present invention is shown. Current source circuit 300 is similar to circuit 200 and functions in a similar manner except that transistor m4 is replaced with a cascode transistor pair 301 and a transistor m5 is added between the drain of transistor m3 and the current source Iref2. A reference voltage input Vref is included in circuit 300 in order to properly bias cascode transistor pair 301.

It should be appreciated that the noise sensitive circuit 201 can be any of a number of circuits which require a constant noise free power supply current (e.g., output current Iout) to function properly. The noise sensitive circuit 201 could be, for example, a VCO cell in a VCO circuit, a frequency synthesizer element, a differential amplifier, or the like.

Figure 4:
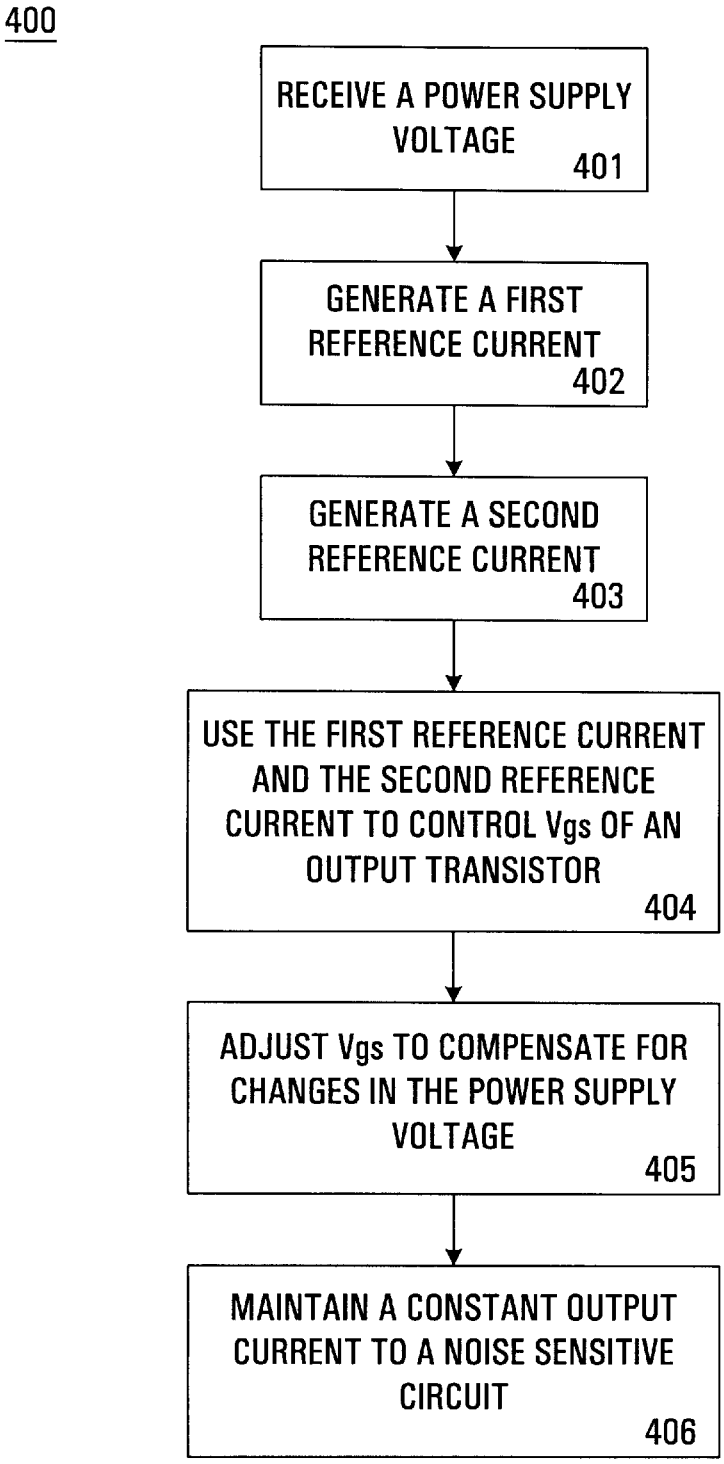
FIG. 4 shows a flow chart of the steps of a process in accordance with one embodiment of the present invention.

FIG. 4 shows a flow chart of the steps of a process 400 in accordance with one embodiment of the present invention. Process 400 shows the process of operation of a circuit in accordance with the present invention. Process 400 begins in step 401, when a current source circuit in accordance with the present invention (e.g., current source circuit 200) receives a power supply voltage from a power supply. The power supply voltage (e.g., Vdd) is coupled to the sources of four transistors (e.g., transistors m1–m4) included in circuit 200.

In step 402, process 400 of the present invention generates a first reference current. As described above, the first reference current is generated by a first reference current source. The first reference current flows a constant amount of current from the drain of transistor m1 to ground.

In step 403, process 400 of the present invention generates a second reference current. The second reference current also flows a constant amount of current to ground. The second reference current is generated by a second reference current source. The second reference current flows from the drains of transistors m2, and m3.

In step 404, the first reference current and the second reference current are used to control Vgs of the output transistor (e.g., transistor m4) which transmits an output current Iout to the noise sensitive circuit. The first and second reference currents, through the action of transistors m1–m3, control the voltage at the node formed by the gate of transistors m3 and m4, the drains of transistors m2 and m3, and the second reference current source Iref2. Vgs of transistor m4 is controlled to adjust for changes in the voltage of Vdd (e.g., due to voltage spikes, noise, etc.).

In step 405, Vgs is adjusted to compensate for changes in the voltage of the power supply Vdd. If Vdd increases, Vgs decreases. If Vdd decreases, Vgs increases.

In step 406, process 400, maintains a constant output current to the noise sensitive circuit. Circuit 200 increases the voltage at the gate of transistor m4 (e.g., if Vdd increases) and decreases the voltage at the gate of transistor m4 (e.g., if Vdd decreases) to maintain a constant output current. In so doing, circuit 200 compensates for the current mirroring problems caused by the impedance of the noise sensitive circuit at the drain of transistor m4. Circuit 200 adjusts Vgs in response to the changes in Vds for transistor m4. This maintains a constant, stable output current to the noise sensitive circuit.

Thus, the present invention provides a VCO circuit which solves the power supply noise problems associated with the prior art. The circuit of the present invention provides a noise free current to coupled noise sensitive circuits. The circuit of the present invention prevents noise sensitive devices from being adversely affected by noise on their power supply and exhibits higher power supply noise rejection than the prior art.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A noise insensitive current source circuit having a high power supply rejection ratio for use with noise sensitive circuits, comprising:

a first reference current source coupled to ground;

a second reference current source coupled to ground;

a first transistor having a source coupled to a power supply and a drain coupled to said first reference current;

a second transistor having a source coupled to said power supply and a drain coupled to said second reference current source, the gate of said second transistor coupled to the gate of said first transistor and to the drain of said first transistor;

a third transistor having a source coupled to said power supply and a drain coupled to ground via said second reference current source, the gate of said third transistor coupled to the drain of said second transistor; and a fourth transistor having a source coupled to said power supply, a drain for coupling to a noise sensitive circuit, and a gate coupled to the gate of said third transistor, wherein said fourth transistor effects a high power supply rejection ratio supplying current from said power supply to said noise sensitive circuit.

2. The circuit of claim 1, wherein said first reference current source generates a constant first reference current, said first reference current passing from said first transistor to ground.

3. The circuit of claim 1, wherein said second reference current source generates a constant second reference current, said second reference current passing from said second and said third transistor to ground.

4. The circuit of claim 1, wherein said second transistor, said third transistor and said second reference current source generate a voltage, said voltage applied to the gate of said fourth transistor.

5. The circuit of claim 1, wherein said first, second, third, and fourth transistors are p-channel transistors.

6. A current source circuit having a high power supply rejection ratio, the current source circuit for providing a constant, noise free current to power a noise sensitive circuit, comprising:

a first reference current source coupled to ground;

a second reference current source coupled to ground;

a first transistor having a source coupled to a power supply and a drain coupled to said first reference current;

a second transistor having a source coupled to said power supply and a drain coupled to said second reference current source, the gate of said second transistor coupled to the gate of said first transistor and to the drain of said first transistor;

a third transistor having a source coupled to said power supply and a drain coupled to said second reference current source, the gate of said third transistor coupled to the drain of said second transistor;

a fourth transistor having a source coupled to said power supply, a drain for coupling to a noise sensitive circuit, and a gate coupled to the gate of said third transistor, said first, second, third, and fourth transistors being p-channel transistors, wherein said fourth transistor effects a high power supply rejection ratio supplying current from said power supply to said noise sensitive circuit.

7. The circuit of claim 6, wherein said first reference current source generates a constant first reference current, said first reference current passing from said first transistor to ground.

8. The circuit of claim 6, wherein said second reference current source generates a constant second reference current, said second reference current passing from said second and said third transistor to ground.

9. The circuit of claim 6, wherein said second transistor, said third transistor and said second reference current source generate a voltage, said voltage coupled to the gate of said fourth transistor.

10. The circuit of claim 6, wherein a plurality of cascode transistors are coupled to provide current to said noise sensitive circuit.

* * * * *